US005186453A

United States Patent [19]

Kühnert

[11] Patent Number: 5,186,453

[45] Date of Patent: Feb. 16, 1993

[54] INTERMEDIATE FILM STORAGE DEVICE

[75] Inventor: Egbert Kühnert, Erzhausen, Fed. Rep. of Germany

[73] Assignee: E. I. du Pont de Nemours and Company, Wilmington, Del.

[21] Appl. No.: 751,482

[22] Filed: Aug. 29, 1991

[30] Foreign Application Priority Data

Sep. 5, 1990 [DE] Fed. Rep. of Germany ..... 4028094

[51] Int. Cl.[5] ..... B65H 7/14

[52] U.S. Cl. ..... 271/270; 271/186; 271/291

[58] Field of Search ..... 271/186, 270, 291, 902

[56] References Cited

U.S. PATENT DOCUMENTS

| | | | |
|---|---|---|---|
| 4,191,369 | 3/1980 | Matsuda | 271/186 X |
| 4,673,176 | 6/1987 | Schenk | 271/186 |
| 4,714,241 | 12/1987 | Randall | 271/186 X |
| 4,817,933 | 4/1989 | Honjo | 271/902 X |
| 4,958,828 | 9/1990 | Saito | 271/186 |
| 4,993,700 | 2/1991 | Winkler | 271/186 |

FOREIGN PATENT DOCUMENTS

| | | |
|---|---|---|
| 0183982 | 10/1985 | European Pat. Off. . |
| 2100882 | 5/1982 | United Kingdom . |
| 2128593 | 10/1982 | United Kingdom . |

*Primary Examiner*—Richard A. Schacher
*Attorney, Agent, or Firm*—Thomas H. Magee

[57] ABSTRACT

An intermediate film storage device for a section of photographic material of limited length comprises feed rolls, exit rolls, intermediate rolls which separate a first buffer from a second buffer, and a guiding device which guides the section of film from the feed rolls to the intermediate rolls. Such an intermediate film storage device serves to equalize different operating speeds of stations for processing photographic material. In so doing, the activity of the processing stations connected in series ahead of the intermediate film storage device should have to be interrupted only for a short time as the intermediate film storage device is being emptied. The intermediate rolls wind the section of film into the first buffer, and rewind it into the second buffer in the opposite direction of motion and at a higher speed, the motion of the section of film in the second buffer being controlled by an arrangement of buffer rolls.

19 Claims, 8 Drawing Sheets

INTERMEDIATE FILM STORAGE DEVICE

BACKGROUND OF THE INVENTION

The invention pertains to an intermediate film storage device for a section of photographic material of limited length (section of film) with feed rolls, exit rolls, intermediate rolls which separate a first buffer from a second buffer, and a guiding device which guides the section of film from the feed rolls to the intermediate rolls.

Films, papers or other light-sensitive coated carriers can be used as photographic materials. A section of photographic material of limited length will be designated in what follows as "section of film". In the automatic processes common today, a section of film must pass through different stations which, under certain circumstances, may each run at different speeds. For example, the section of film passes an exposure station in which it is exposed to light at predetermined points to produce an image and a development station in which the image exposed in the exposure station is developed and fixed. If a photo-composition instrument or scanner is used at the exposure station, the speed of the section of film varies as it passes through this instrument. However, the section of film must also pass through a roll development machine which in many cases, is used as a development station through which the film section passes at a constant speed so that the chemical processes necessary for developing and fixing can occur at predetermined times.

In order to equalize the operating speeds of the various stations, it is known to use intermediate film storage devices. In the intermediate film storage device, the section of film is typically laid into a loop which forms a certain reserve of film with the aid of which the different speeds at neighboring stations can be equalized. In a known intermediate film storage device (European Patent EP 183,982 B1), the intermediate film storage device contains two buffers which are separated by an arrangement of intermediate rolls. This known intermediate film storage device, however, is intended for a continuous film, i.e., not for sections of film. For example, after a separation of the film due to certain operating conditions, both of the buffers are needed to be able to re-introduce the new head of the film again into the intermediate film storage device as quickly as possible, without having to wait for the intermediate film storage device to become completely empty. To do so, the separated end of the film is rewound from the first buffer to the second buffer. The first buffer, which will then be empty, can then be provided with the head of the film and the succeeding fresh film. However, the known intermediate film storage device is not suitable for processing sections of film.

It is the object of the present invention to provide an intermediate film storage device which is suitable for the intermediate film storage of sections of film without negatively influencing the operation of adjacent stations.

SUMMARY OF THE INVENTION

The present invention comprises an intermediate film storage device for a section of photographic material of limited length comprising feed rolls, exit rolls, intermediate rolls which separate a first buffer from a second buffer, and a guiding device which guides the section of film from the feed rolls to the intermediate rolls. Such an intermediate film storage device serves to equalize different operating speeds of stations for processing photographic material. In so doing, the activity of the processing stations connected in series ahead of the intermediate film storage device should have to be interrupted only for a short time as the intermediate film storage device is being emptied. The intermediate rolls wind the section of film into the first buffer, and rewind it into the second buffer in the opposite direction of motion and at a higher speed, the motion of the section of film in the second buffer being controlled by an arrangement of buffer rolls.

DETAILED DESCRIPTION OF THE PREFERRED EMBODIMENTS

Figure 1:
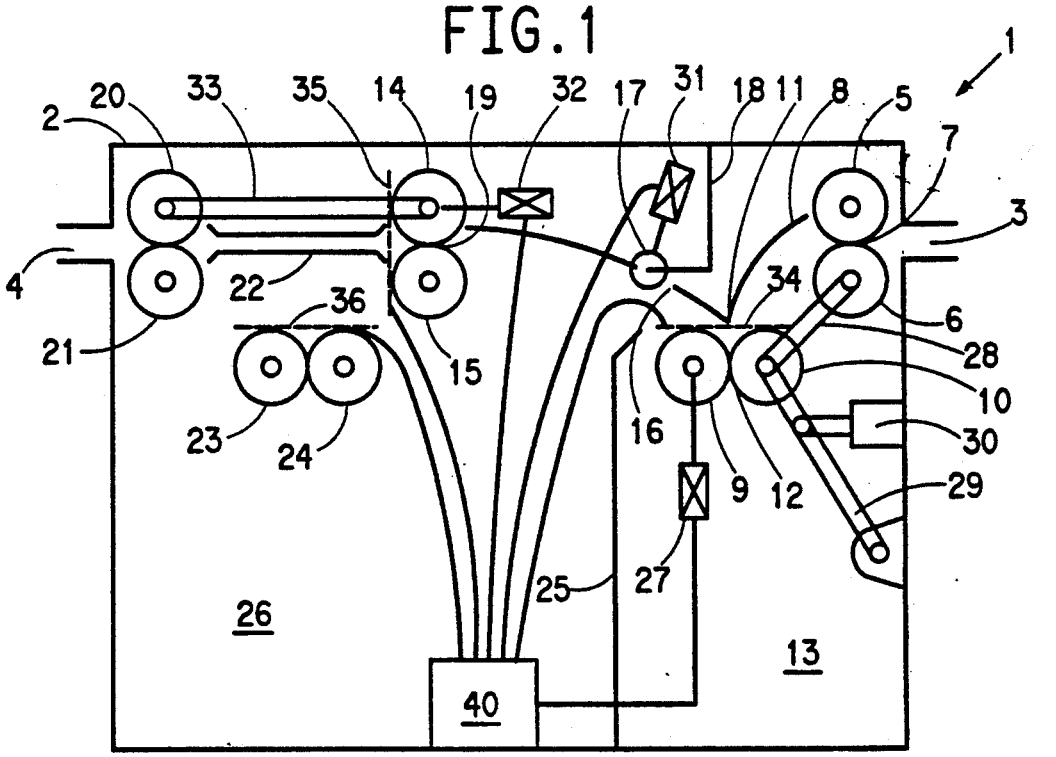
FIG. 1 shows an elevation view of a first embodiment of an intermediate film storage device.

FIG. 1 shows an intermediate film storage device 1 comprising a housing 2 with an entrance slot 3 and an exit slot 4. The housing 2 is constructed to be lightproof. The intermediate film storage device 1 stores a section of limited length of a photographic material which passes through the intermediate film storage device from right to left. The photographic material can be a light-sensitive film, a light-sensitive paper or another carrier provided with a light-sensitive layer which, for example, is to be transported from an exposure device to a development device. A pair of feed rolls 5, 6 that form nip 7 is arranged behind the entrance slot 3. On the side of the nip 7 of the pair of feed rolls, opposite the entrance slot 3, is arranged a guiding device 8 which leads in an arc to a pair of intermediate rolls 9, 10 that form nip 12. The pair of intermediate rolls is so arranged that both its axes lie in the same horizontal plane. The guiding device 8 has a diverting edge 11 which is arranged above the pair of intermediate rolls 9, 10 and to the right of a (vertical) plane intersecting the nip 12 of the pair of intermediate rolls. The diverting edge 11 is thus located ahead of the nip 12 of the intermediate rolls 9, 10 with reference to the direction of motion of the section of film through the intermediate film storage device 1. A first buffer 13, i.e., a free space into which the section of film can be wound, is provided below the pair of intermediate rolls 9, 10.

The guiding device 8 extends from the pair of intermediate rolls 9, 10 further in the direction of a pair of buffer rolls 14, 15 that form nip 19. Between the pair of intermediate rolls 9, 10 and the pair of buffer rolls 14, 15 the guiding device 8 exhibits a break 16 in which a roll 17 is arranged. The roll 17 is mounted eccentrically on a support 18 attached to the housing and will be called the eccentric roll in what follows. The axes of the pair of buffer rolls 14, 15 are arranged in a vertical plane. The guiding device 8 terminates in the direction of transport just ahead of and slightly above the roll nip 19 formed between the pair of buffer rolls 14, 15. A pair of exit rolls 20, 21 is arranged in the direction of transport ahead of the exit slot 4. Between the pair of buffer rolls 14, 15 and the pair of exit rolls 20, 21 a buffer guiding device 22 is arranged which defines a channel between the pair of buffer rolls 14, 15 and the pair of exit rolls 20, 21.

Below the space between the pair of buffer rolls 14, 15 and the pair of exit rolls 20, 21 is arranged a pair of reversing rolls 23, 24, the axes of which lie in a horizontal plane. The pair of reversing rolls has no significance for the embodiment illustrated in FIG. 1. The first buffer 13 is delimited on the one hand by the housing 2, on the other hand by a partition 25. The partition, at the same time, delimits together with the housing 2 a second buffer 26.

The pair of intermediate rolls 9, 10 is driven by an intermediate roll drive 27. In so doing, one of the intermediate rolls 9 drives the second intermediate roll 10 via a pinion (not shown). The second intermediate roll 10 is connected via a toothed belt 28 to one of the feed rolls 6 which in turn drives the other feed roll 5 so that the intermediate roll drive 27 also drives the feed rolls 5, 6. By choosing a suitable transmission ratio, a synchronous transport speed of the pair of feed rolls and the pair of intermediate rolls can be achieved. The intermediate roll 10 is seated on a lever 29, seated in the housing 2, so that the roll 10 can be moved away from the other intermediate roll 9 by a piston-cylinder unit 30. In this case, the roll nip 12 between the intermediate rolls is enlarged. A section of film which finds itself between the intermediate rolls 9, 10 can then neither be driven nor braked by the intermediate rolls 9, 10 but slides freely into the roll nip 12.

The eccentric roll 17 can be driven in a controlled manner by a drive 31, i.e., it can rotate permanently or, if desired, it can rotate once only. The buffer roll 14 can be driven by a drive 32. The buffer roll 14 is connected to the exit roll 20 via a toothed belt 33 so that a synchronous drive of the pair of buffer rolls 14, 15 and the pair of exit rolls 20, 21 can be achieved.

Above the pair of intermediate rolls 9, 10 is arranged an intermediate roll sensor 34 which detects the presence of a section of film in the region between the diverting edge 11 of the guiding device 8 and the roll nip 12 of the pair of intermediate rolls 9, 10. A buffer roll sensor 35 is arranged behind the pair of buffer rolls in the transport direction which detects the presence of a section of film behind the pair of buffer rolls 14, 15. It can, for example, also be arranged immediately ahead of the exit slot 4. Above the pair of reversing rolls 23, 24 is arranged a reversing roll sensor 36 which detects the presence of a section of film in this region.

Figure 3:
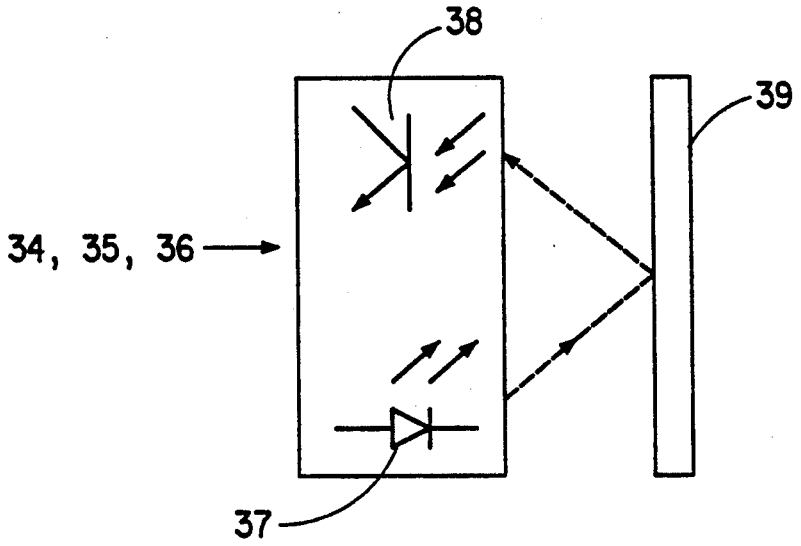
FIG. 3 shows a schematic elevation view of a sensor.

Intermediate roll sensor 34, buffer roll sensor 35 and reversing roll sensor 36 may be constructed identical in principle. An embodiment of such a sensor is illustrated in FIG. 3. Each sensor exhibits at least one light diode 37 and a photo-transistor 38. Light diode 37 and photo-transistor 38 are arranged on one side of the track along which the section of film moves. A mirror 39 is arranged on the other side. The photo-transistor receives the light emitted by light diode 37 and reflected by mirror 39 as long as there is no section of film between the mirror 39 and the photo-transistor 38 or the light diode 37, respectively. If, on the other hand the section of film interrupts the light beam from the light diode 37 to the photo-transistor 38, the appropriate sensor 34, 35, 36 detects the presence of the section of film. The light emitted by the light diode 37 must be chosen such that it does not expose the photographic material, for example, an infrared-emitting light diode can be employed if the photographic material is insensitive to infrared light. Other sensors are, of course, conceivable, for example, ultra-sound sensors or mechanical feelers which exhibit a mechanical switch which is actuated by the section of film.

Sensors 34, 35, 36 and drives 31, 32 and 27 are connected to a control device 40 which controls drives 27, 31, 32, among others, as a function of the signals of sensors 34, 35, 36. In so doing, the electrical lines which connect the control device 40 to the drives or sensors, respectively, run along the wall of the housing 2. Thus, the second buffer 26 remains essentially free of electrical lines.

Figure 2:
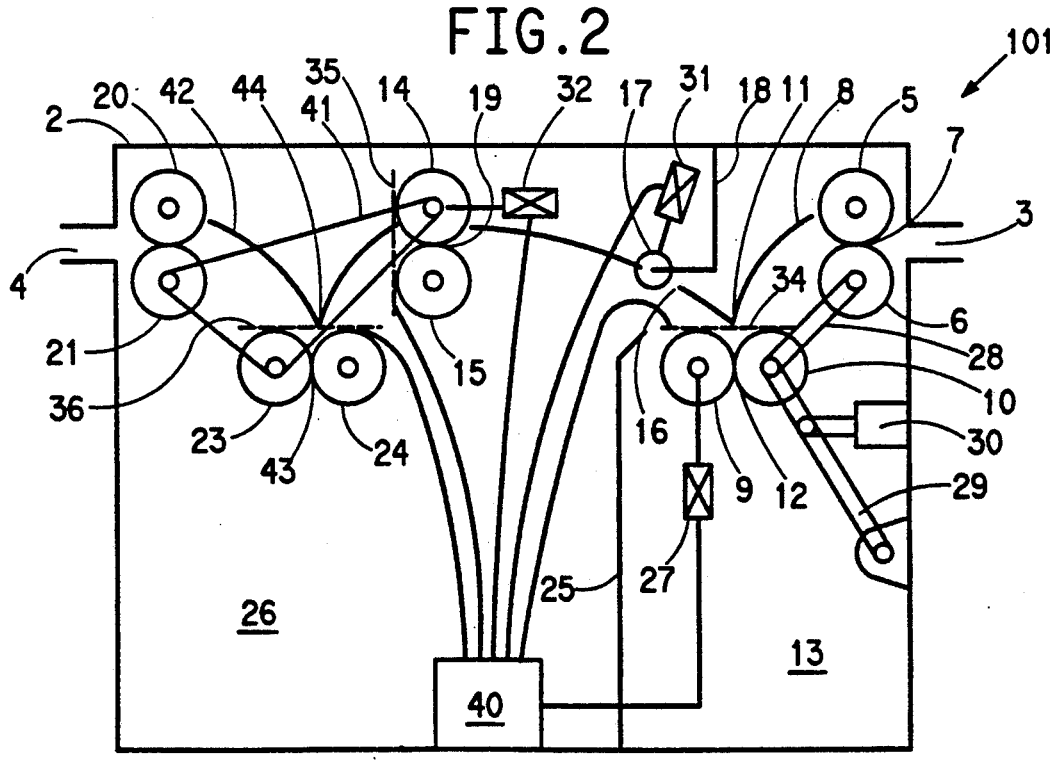
FIG. 2 shows an elevation view of a second embodiment of the intermediate film storage device.

FIG. 2 shows an additional embodiment of an intermediate film storage device 101. Elements which correspond to those of FIG. 1 are provided with the same reference numbers. In contrast to the intermediate film storage device 1 according to FIG. 1, the pair of reversing rolls 23, 24 is activated here. It is also driven by a toothed belt 41 from the buffer roll 14, i.e., by its drive 32. The toothed belt 41 is run such that the pair of exit rolls 20, 21 rotates in the direction opposite to that of the pair of buffer rolls 14, 15. Furthermore, the buffer guiding device 22 is replaced by a reversing guiding device 42, constructed similar in principle to the guiding device 8, between the pair of feed rolls 5, 6 and the pair of buffer rolls 14, 15. The reversing guiding device 42 exhibits a diverting edge 44 which, seen in the direction of transport of the section of film through the intermediate film storage device 101, is arranged ahead of the roll nip 43 between the reversing rolls 23, 24 and above the reversing rolls 23, 24. The reversing roll sensor 36 detects the presence of the section of film between the diverting edge 44 and the reversing rolls 23, 24.

The operation of the guiding device 8 or the reversing guiding device 42, respectively, can be described as follows by means of the interaction between the pair of feed rolls 5, 6, the pair of intermediate rolls 9, 10 and the pair of buffer rolls 14, 15. A section of film is driven by the pair of feed rolls 5, 6. The head of the section of film slides along the guiding device 8 and is guided by it up to the pair of intermediate rolls 9, 10. In so doing, it is unimportant the guiding device 8 does not guide the head of the film right up to the roll nip 12 of the pair of intermediate rolls 9, 10 since the material of the section of film exhibits a certain inherent stiffness. As soon as the head of the section of film is no longer guided by the guiding device 8, it continues to move straight ahead, being pulled downward slightly by gravity. As soon as it comes in contact with intermediate roll 10 which is driven by drive 27 and the intermediate roll 9, the head of the section of film is gripped and transported into the roll nip 12. Since the pair of intermediate rolls 9, 10 and the pair of feed rolls 5, 6 are driven synchronously by the toothed belt, the section of the film is now wound into the first buffer. As soon of the intermediate roll sensor 34 reports that there no longer is any section of film in the region monitored by it, the drive 27 of the pair of intermediate rolls is shut down and reversed. The end of the section of film is now transported upward, where, due to its inherent stiffness it now meets up with the section of guiding device 8 which is arranged between the diverting edge 11 and the pair of buffer rolls 14, 15. The reversing guiding device 42 operates in the same manner.

Figure 4A:
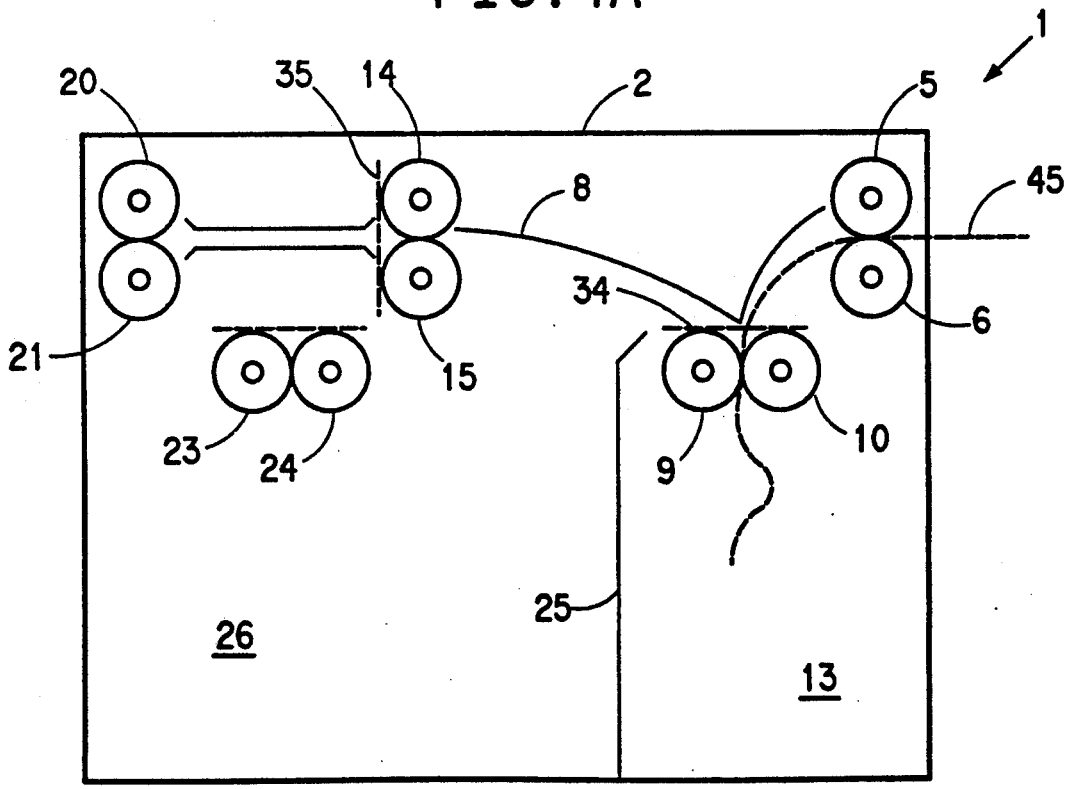
FIGS. 4*a–e* are elevation views showing the path of a section of film through the intermediate film storage device including reversal of the section of film.
Figure 4B:
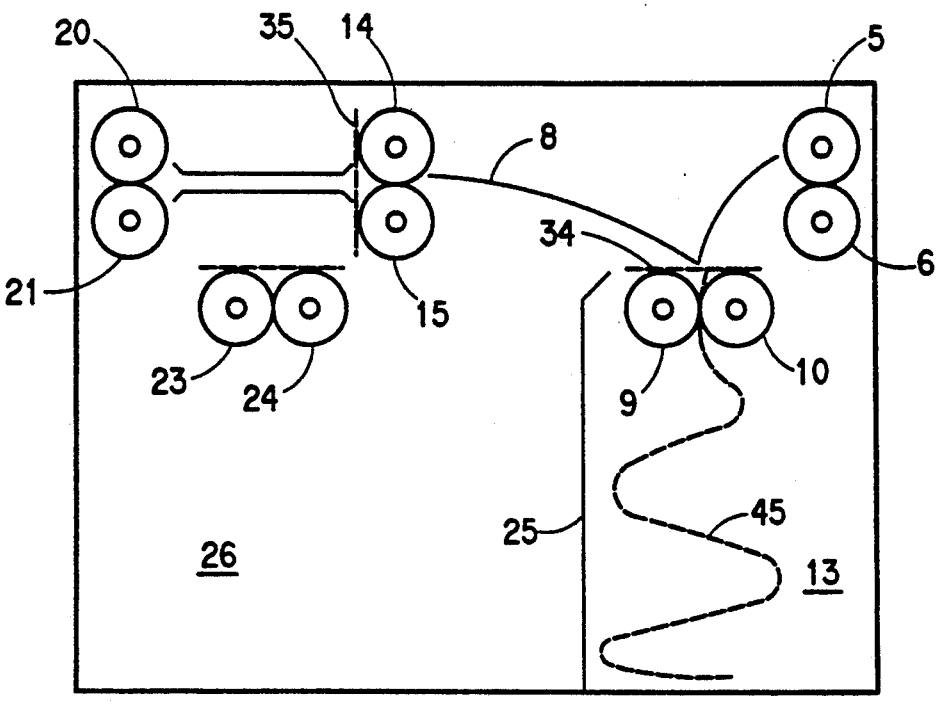
Figure 4C:
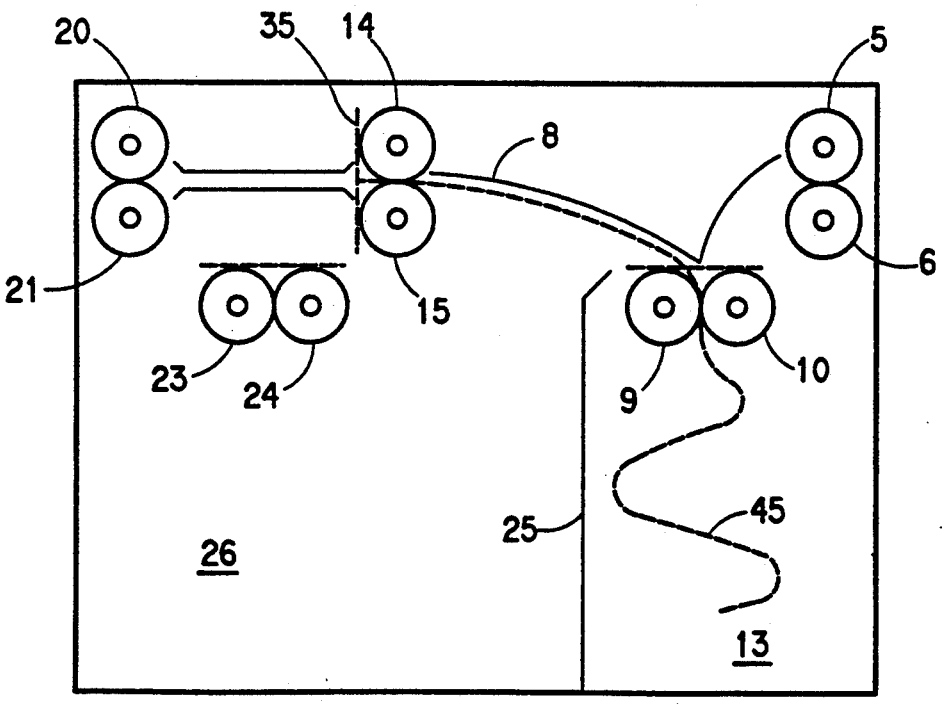
Figure 4D:
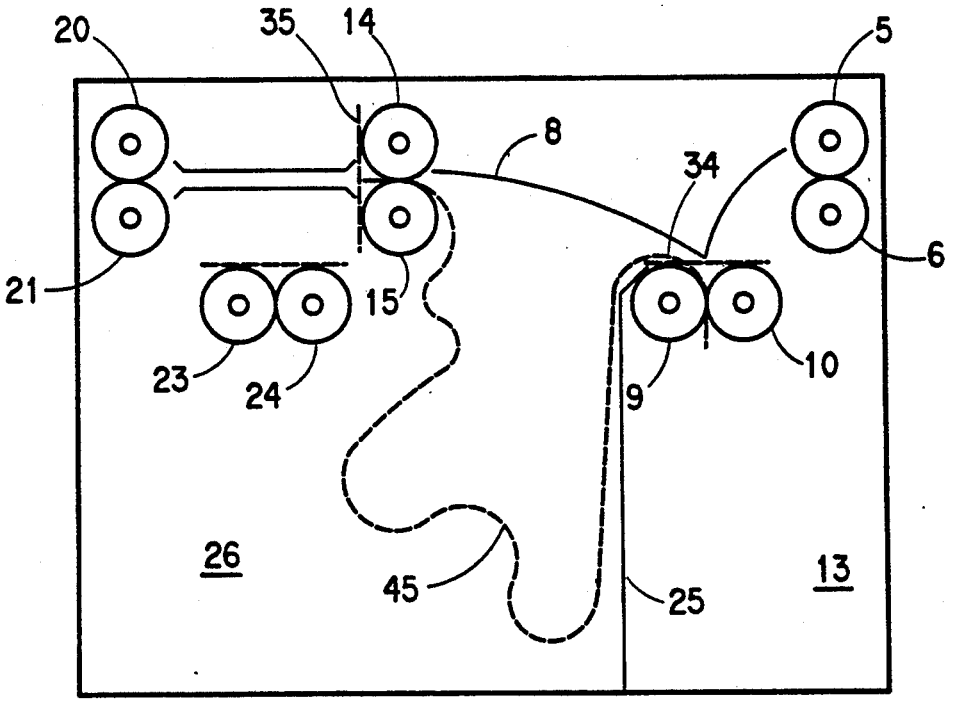

FIGS. 4*a* through 4*e* show in schematic form the operation of the intermediate film storage device 1 according to FIG. 1. The individual drives have been omitted for clarity. A first section of film 45 is wound into the intermediate film storage device 1 with the aid of feed rolls 5, 6. In so doing it is guided by guiding device 8 to the intermediate rolls 9, 10. The intermediate rolls 9, 10 grip the first section of film 45 and wind it into the first buffer 13 at a speed which corresponds to that at a station connected in series ahead of the intermediate film storage device 1. Here, transport can also be intermittent. The intermediate roll sensor 34 detects whether a section of film is present in the monitored region or not (FIG. 4*a*). In FIG. 4*b* the first section of film 45 has been wound completely into the first buffer 13. The intermediate roll sensor 34 reports that the section of film is no longer present in the region monitored by it. The drive of the intermediate rolls 9, 10 is stopped. FIG. 4*c* shows the step where the pair of intermediate rolls 9, 10 reverses the direction of motion of the section of film 45 and transports the section of film in the direction of the buffer rolls 14, 15. The section of film now moves tail first in the direction of the exit rolls 20, 21. In so doing, the guiding device 8 assures that the tail of the film actually runs in the right direction and is not pushed back toward the feed rolls 5, 6. The buffer rolls 14, 15 preferably run at the same speed as the intermediate rolls 9, 10. If that cannot be accomplished, the buffer rolls 14, 15 run at a slightly higher speed, i.e., they transport the section of film 45 at a slightly higher speed than the intermediate rolls 9, 10. As soon as the buffer roll sensor 35 detects the presence of the section of film in the region monitored by it, the drive of buffer rolls 14, 15 is shut down. However, the intermediate rolls 9, 10 continue the transport. Due to the arc shape of the guiding device 8, a small compressive stress is built up in the section of film 45. At this moment drive 31 is actuated which rotates the eccentric roll 17 once or several times about its axis. By so doing the section of film is pushed away from the guiding device 8. The compressive stress now causes the section of film to drop into the second buffer 26. In so doing it is gripped by the buffer rolls 14, 15 while it is being completely wound into the second buffer by the intermediate rolls 9, 10 (FIG. 4*d*). As soon as the intermediate roll sensor 34 reports that the section of film is no longer present in the region monitored by it, the feed rolls 5, 6 can wind a second section of film into the first buffer 13. The first section of film 45 can be wound out of the second buffer 26 at a speed adjusted to the processing speed of the succeeding station.

Rewinding from the first buffer 13 into the second buffer 26 occurs at a speed greater than the winding of the section of film into the first buffer. Even if drive 27 of the intermediate rolls 9, 10 during forward and backward motion can produce the same maximum speed, the speed when winding out of the first buffer 13 is still substantially higher than when winding into it, since the section of film is driven only intermittently during winding in, especially when the exposure station serially ahead of the intermediate film storage device is designed as a scanner. It is preferred that winding out of the first buffer 13 occur at a speed greater than the speed during winding in by a factor of 5 to 10. The drive 27 of the pair of intermediate rolls 9, 10 can then be designed such that it has a substantially higher speed of winding the section of film out of the first buffer 13 than for winding it in. The speed for winding out and winding in can indeed differ by a factor of 100. Rewinding thus occupies only a fraction of the time of winding the section of film into the first buffer 13, so that the activity of the exposure station needs to be interrupted only for very short periods of time if at all.

Figure 5B:
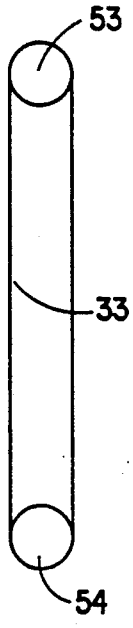
FIGS. 5A, 5B show a drive arrangement for driving a pair of buffer rolls and exit rolls.
Figure 5A:
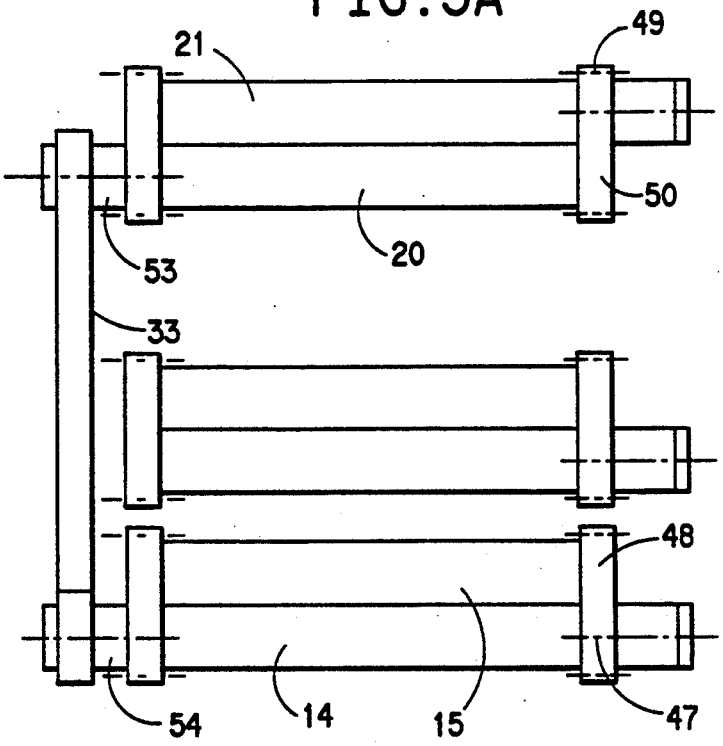

FIGS. 5A, 5B show that in the embodiment illustrated in FIG. 1, the buffer rolls 14, 15 and the exit rolls 20, 21 each rotate, respectively, in the same direction. The rotation of the buffer roll is transmitted to the other buffer roll with the aid of two pinions 47, 48 which intermesh. In the same manner the exit roll 21 is driven by the exit roll 20, i.e., by two pinions 49, 50 which intermesh and are solidly connected to the two roll axes so as to rotate with them. The exit roll 20 exhibits a toothed belt pinion 53. The buffer roll 14 exhibits a toothed belt pinion 54. The toothed belt 33 rests on the two toothed belt pinions 53, 54 and transmits the motion of the pair of buffer rolls 14, 15 to the exit rolls 20, 21.

Figure 6A:
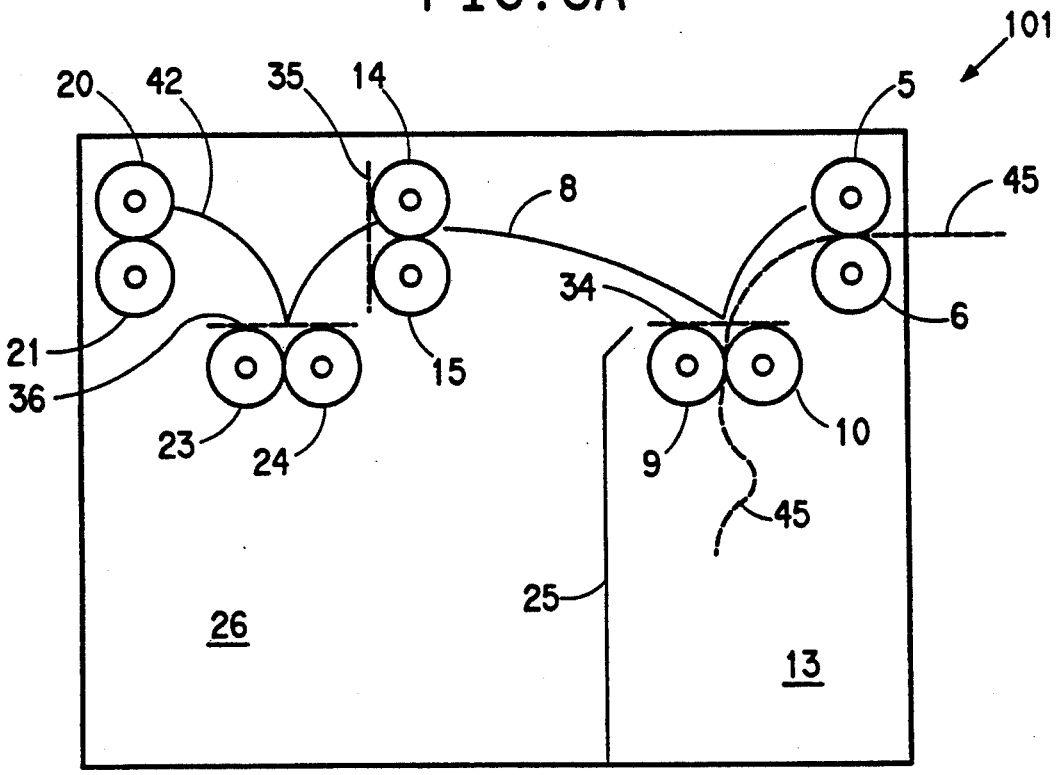
FIGS. 6*a–e* are elevation views showing the path of the section of film through the intermediate film storage device without reversal of the section of film.
Figure 6B:
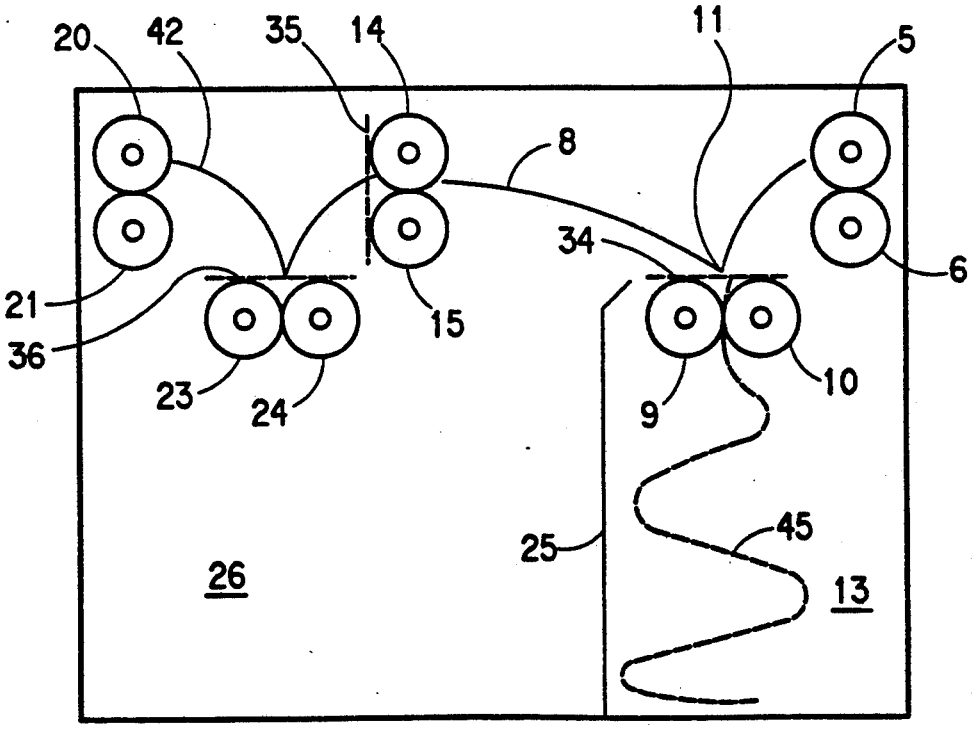
Figure 6C:
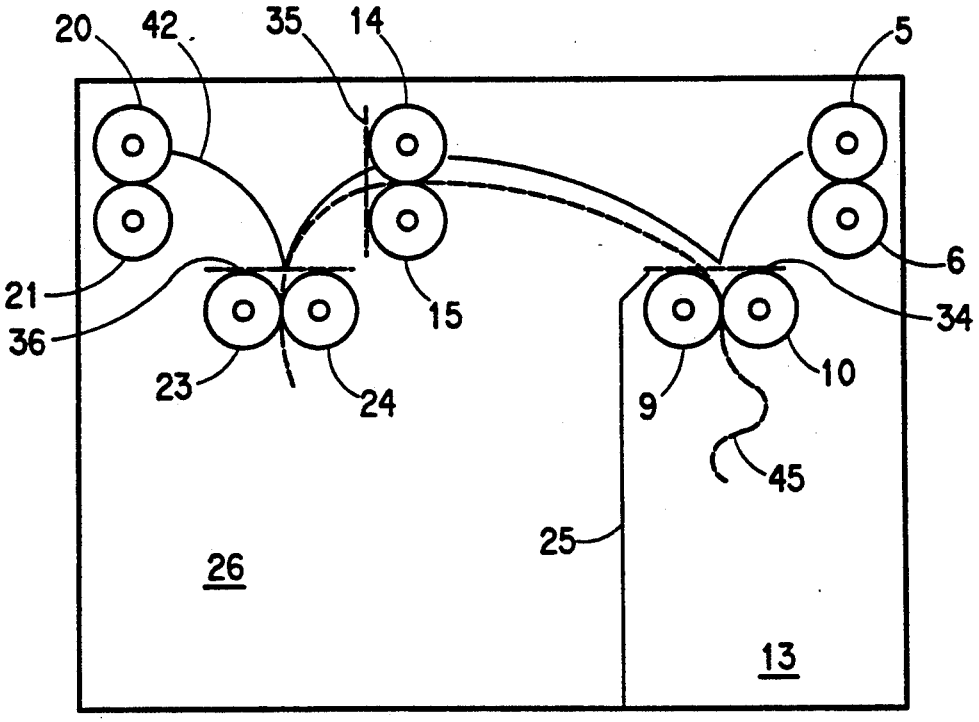
Figure 6D:
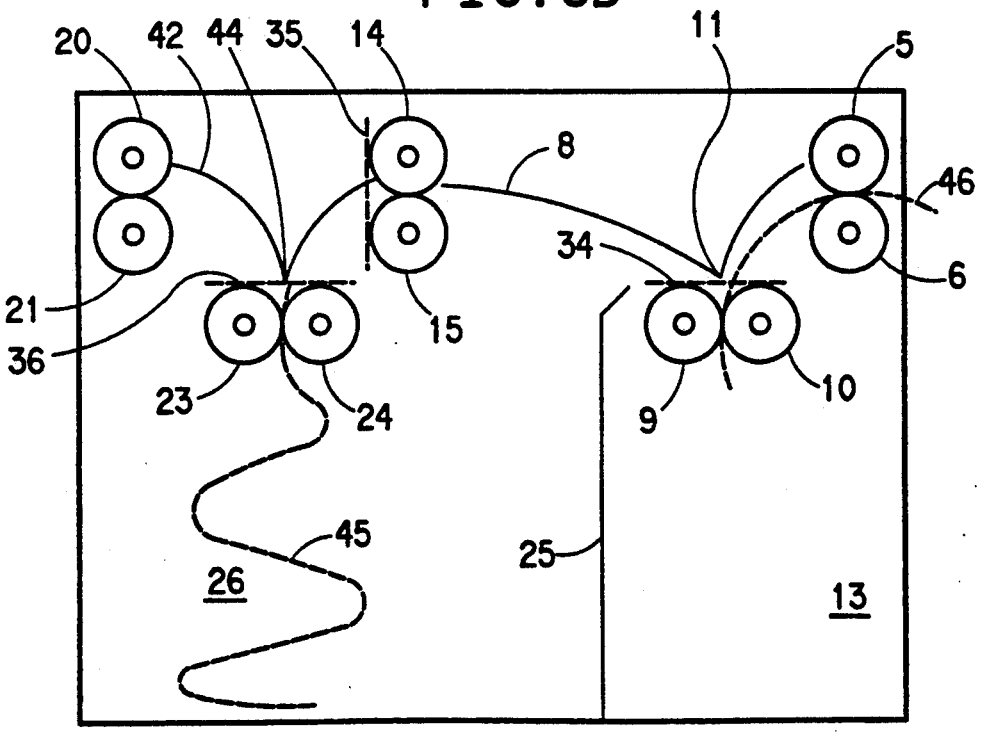
Figure 6E:
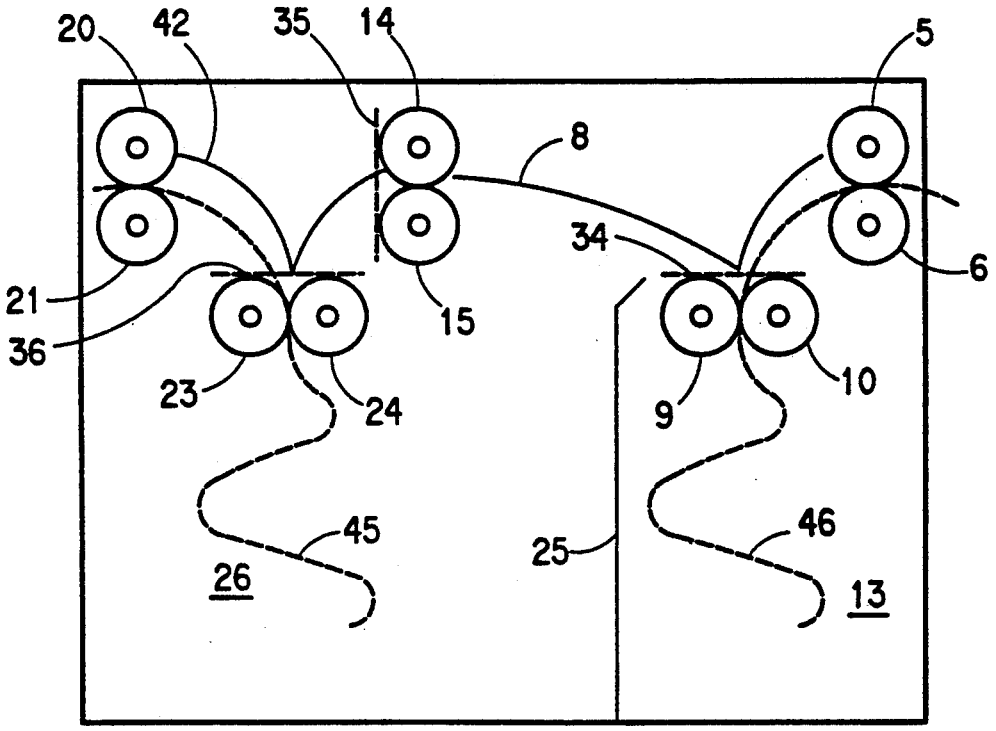

FIGS. 6*a* through 6*e* show the positions of a first section of film 45 and of a second section of film 46 as they make their way through the intermediate film storage device 101. The sections of film 45, 46, in contrast to the process events illustrated in FIG. 4, emerge from the intermediate film storage device 101 precisely as they were brought into it, i.e., original head first. As shown in FIGS. 6*a* and 6*b*, the operation of the intermediate film storage device 101 is identical to the operation of the intermediate film storage device 1 shown in FIGS. 4*a* and 4*b*. As soon as the intermediate roll sensor 34 has determined that the section of film has been wound sufficiently far into the first buffer 13, i.e., that its end has passed the diverting edge 11 of the guiding device 8, the intermediate rolls 9, 10 reverse their direction of rotation and transport the section of film 45 in the direction of the buffer rolls 14, 15. As soon as the buffer roll sensor 35 reports the presence of the section of film 45, i.e., that it has been ascertained that the buffer rolls 14, 15 have gripped the section of film 45 (FIG. 6*c*), the piston-cylinder unit 30 can be activated so as to open the roll nip 12 of the pair of intermediate rolls 9, 10. The buffer rolls 14, 15 can then pull the section of film 45 out of the first buffer without the intermediate rolls 9, 10 again having to become active.

The buffer rolls 14, 15 transport the film along the guiding device 42 to the reversing rolls 23, 24 and from there into the second buffer 26. This time, therefore, the tail of the section of film 45 is first to be transported into the second buffer 26. As soon as the intermediate roll sensor 34 reports that it can no longer detect any film in the region monitored by it, the first buffer 13 can again be filled with a second section of film 46. At this point in time, the first section of film 45 is located in the second buffer 26.

Figure 4E:
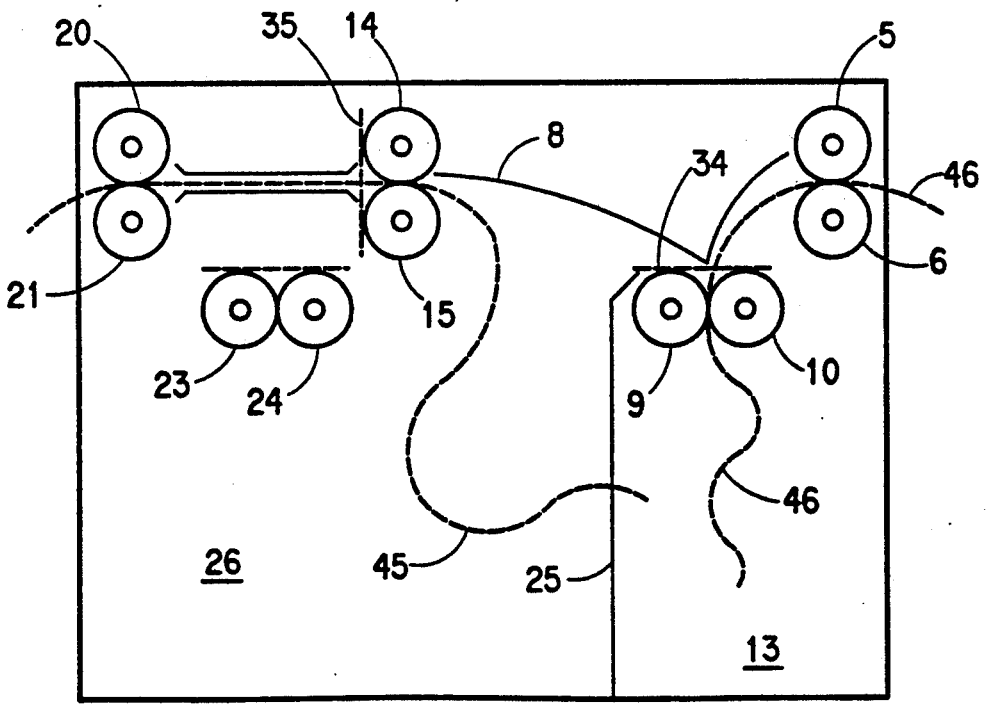

As soon as the reversing roll sensor 36 determines that there is no longer any section of film present in the region monitored by it, the direction of rotation of the reversing rolls 23, 24 is reversed and the section of film 45 is transported along the guiding device 42 to the exit rolls 20, 21 (FIG. 4*e*). In so doing, it is assured by diverting edge 44 that the original head of the first section of film 45 is transported in the direction of the exit rolls 20, 21 and not back toward the buffer rolls 14, 15. Since rewinding from the first buffer 13 into the second buffer 26 occurs at increased speed, the first buffer is ready after a very short period of time to again accept a section of film 46 without the supplying device, e.g., the exposure device which serially precedes the intermediate film storage device, being forced to interrupt its activity for a prolonged period of time.

The deflection of the tail of the film or of the head of the film, respectively, with the aid of the guiding device 8 or the reversing guiding device 42 can also occur in a different manner than via a diverting edge 11 or 44, respectively. For example, the guiding device 8 or the reversing guiding device 42, respectively, may also exhibit moving parts which are appropriately redirected and fulfill the function of a shunt. However, it has turned out that even with the static guiding device 8 or the reversing guiding device 42, respectively, reliable guidance of each section of film can be achieved.

Figure 7A:
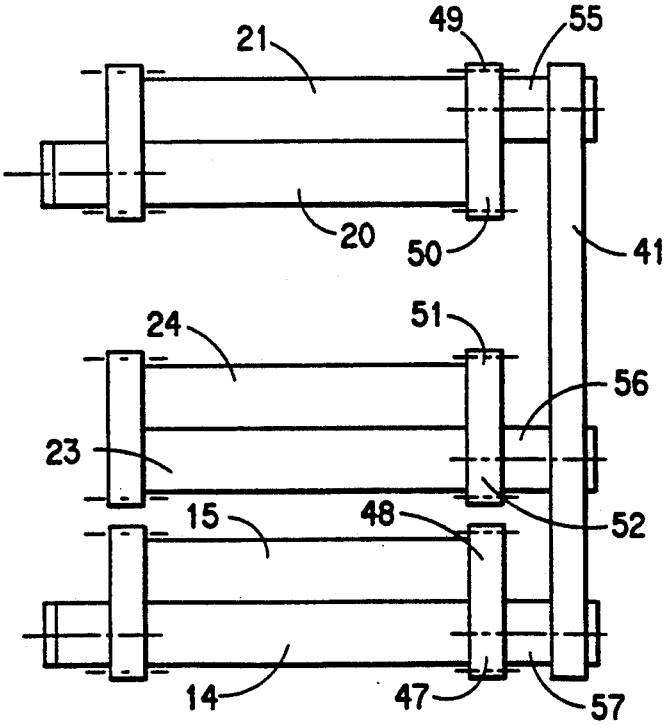
FIGS. 7A, 7B show a drive arrangement for moving the pair of buffer rolls and exit rolls in opposite directions.
Figure 7B:
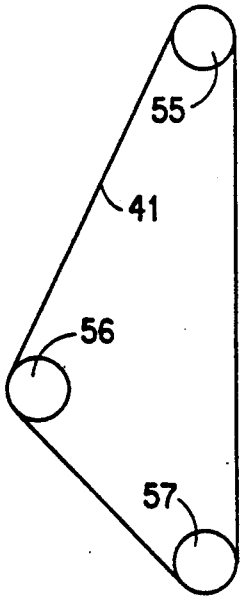

FIGS. 7A, 7B show the interrelation of the drives between the buffer rolls 14, 15, the exit rolls 21, 22 and the reversing rolls 23, 24. The buffer roll 14 always rotates in the same direction as the reversing roll 23. The reversing roll 23 always rotates in the same direction as the exit roll 21. It follows that the exit roll 20 always rotates in the direction opposite to that of the buffer roll 14. This is accomplished by having the individual pairs of rolls, which are each geared together by pinions or friction wheels 47, 48 or 49, 50 or 51, 52, respectively, connected by the toothed belt 41 which transfers its power with the aid of toothed belt pinions 55, 56, 57 to the individual pairs of rolls.

As can be seen especially by comparing FIGS. 5A, 5B and 7A, 7B intermediate film storage device 101 in which the section of film is reversed twice, i.e., in the final analysis leaves the intermediate film storage device without reversal, can be realized from the intermediate film storage device 1, in which the film is reversed, by simply interchanging toothed belt 33 and toothed belt 41, and by interchanging the buffer guiding device 22 and the reversing guiding device 42.

In the present invention, the intermediate rolls wind the section of film into the first buffer and rewind it in the opposite direction of motion and at a speed higher, at least on average, into the second buffer, the motion of the section of film in the second buffer being controlled by an arrangement of buffer rolls. The first buffer is thus emptied at a higher speed than it is being filled. The first buffer is, therefore, again ready after a short while to accept a new or second section of film. The old or first section of film can be wound out of the second buffer at a speed adjusted to the speed of the processing station following the intermediate film storage device. This can be at a higher or at a lower speed than the winding of the section of film into the first buffer. The operating speeds of the stations connected by the intermediate film storage device are, therefore, completely de-coupled. Even longer sections of film can be intermediately stored in the intermediate film storage device without problem. In so doing, it is not necessary for the intermediate film storage device to exhibit the length of the longest section of film to be processed, since the first buffer effects a reversal in direction of the section of film. The end of the section of film which was the last to be wound into the first buffer will be the first to again be wound out of the first buffer.

The guiding device continues from the intermediate rolls to the buffer rolls and guides the section of film during rewinding into the second buffer. The guiding device thus has the additional task of converting the reversal in direction of motion of the section of film effected by the intermediate rolls into a continuation of the transport motion of the section of film through the intermediate film storage device. To do so, the guiding device can be designed, for example, as a shunt which guides the tail of the film in the same direction as the head of the film, i.e., for example, from right to left, even though the direction of motion of the section of film has reversed itself.

Preferably, the guiding device exhibits a diverting edge for this purpose which is arranged on the side of a plane intersecting the roll nip of the intermediate rolls, away from the second buffer, and adjacent to the intermediate rolls. The photographic material exhibits a certain inherent stiffness. The guiding device is arranged with its diverting edge adjacent to the roll nip of the intermediate rolls such that the head of the section of film which is being guided from the feed rolls to the intermediate rolls can enter the roll nip of the intermediate rolls without problems. There it is gripped by the intermediate rolls and wound into the first buffer. In so doing, the section of film may possibly slide along the diverting edge. When the section of film has been wound completely into the first buffer, the end of the section of film is held only by the intermediate rolls. Based on the inherent stiffness of the photographic material which forms the section of film, the end of the section of film now lies in the plane which intersects the roll nip of the intermediate rolls. Upon reversal of the direction in which the intermediate rolls are driven, the diverting edge now lies on the side of the section of film away from the second buffer so that the guiding device can pick up the tail of the section of film and guide it in the direction toward the second buffer.

Preferably, the intermediate rolls move the section of film essentially vertically. One need not fear that the end of the section of film should be so distorted by gravity that the guiding device can no longer pick it up properly. Should it not be possible to arrange the intermediate rolls such that the section of film is moved vertically, the diverting edge should be arranged above the roll nip of the intermediate rolls, i.e., in the direction opposite the force of gravity.

Preferably, the guiding device exhibits in the section between the intermediate rolls and the buffer rolls, a sliding surface and also a deflection device which moves a part of the section of film away from the sliding surface once it has been grasped by the buffer rolls. The intermediate rolls now wind the section of film out of the first buffer, whereby it makes contact with the guiding device due to its inherent stiffness. It may now be desirable to remove the section of film from the guiding device, for example, when the region between the intermediate rolls and the buffer rolls is to be used as second buffer or when a small loop of section of film is to be formed between the intermediate rolls and the buffer rolls to equalize possible differences in speed between the drive of the intermediate rolls and the drive of the buffer rolls. The deflecting device acts on the section of film for a short time or continuously, and moves it against its inherent stiffness away from the guiding device such that the thrust applied by the intermediate rolls completely removes the section of film from the sliding surface of the guiding device. Beginning with a certain deflection, the section of film fairly jumps away from the sliding surface. Preferably, the deflection device is designed as an eccentric roll. By simple rotation of the eccentric roll about its axis, the section of film is pushed away from the sliding surface.

In a preferred embodiment, an intermediate roll sensor is arranged between the guiding device and the intermediate rolls which senses the presence of the section of film in this region and controls a drive of the intermediate rolls. The intermediate rolls serve, among others, to wind the section of film into the first buffer. For this purpose, the intermediate rolls are driven in a certain direction. The intermediate roll sensor now detects the presence of the section of film in the region between the guiding device and the intermediate rolls. As long as there is material in this region, it means that the section of film has not yet been completely wound into the first buffer. Only when the intermediate roll sensor detects that there no longer is any material present, is it a sign that the section of film has been wound far enough into the first buffer. The intermediate rolls can now be shut down. The end of the section of film is held by the intermediate rolls. In so doing, it is not important that the section of film has been completely, i.e., except for a few centimeters, wound into the first buffer. The key, rather, is the fact that the section of film has been wound into the first buffer far enough so that the end of the section of film is deflected toward the second buffer by the guiding device once the direction of motion is reversed. Thus, the end of the section of film must have been moved past the diverting edge.

Preferably, the buffer rolls are driven at least at the same speed as the intermediate rolls. When the intermediate rolls wind the section of film out of the first buffer in the opposite direction, the end of the section of the opposite direction, the end of the section of film is guided by the guiding device up to the buffer rolls. The buffer rolls can now grip the end of the section of film. Ideally, the transport speeds of the intermediate rolls and the buffer rolls should be identical. Since this can be realized only at considerable cost, it is preferred that, if synchronous running cannot be achieved, the buffer rolls have a higher speed than the intermediate rolls. This is not critical since the section of film is guided by the guiding device in an arc. When the buffer rolls move the section of film at a speed greater than the intermediate rolls, this arc will be straightened without subjecting the section of film to an indue tension.

In an especially preferred embodiment, the buffer rolls have a buffer sensor which detects the presence of a section of film in a pre-determined region, and an output signal of the sensor controls a buffer roll drive. When the buffer roll sensor detects the presence of the section of film, it shuts down, e.g., the drive of the buffer rolls. The intermediate rolls continue to move the section of film. The deflection device removes the section of film from the sliding surface such that the section of film is now wound into the second buffer by the intermediate rolls. After a pre-determined time which is generously proportioned to wind even the longest section of film into the second buffer, or when the intermediate roll sensor reports that the section of film is no longer present, the drive of the intermediate rolls is shut down. The section of film is now completely taken up in the second buffer, its tail now pointing forward in the direction of motion, i.e., the section of film thus having been reversed once. When the section of film has been completely wound into the second buffer it can be transported by the buffer rolls to the exit rolls, whereupon the exit rolls can take over the transport of the section of the film to the next processing station. At the same time, the intermediate film buffer can now accept a new section of film.

In another embodiment, the buffer rolls are formed by a pair of buffer rolls and a pair of exit rolls, connected by a buffer guiding device. The buffer guiding device takes over guidance of the section of film from the pair of buffer rolls to the pair of exit rolls. Both pairs of rolls can be driven by a common drive so that they run synchronously and the section of film can be transported without producing compressive of tensile stresses.

The buffer roll sensor can be provided at any point adjacent the buffer rolls. A prerequisite is merely for the buffer rolls to be able to grip the section of film, i.e., that it has been wound far enough into the buffer rolls so that it is securely gripped by at least one pair of rolls. In the present embodiment, the buffer roll sensor is arranged at the exit of the buffer rolls, i.e., in the direction of motion behind the pair of exit rolls. Preferably, the buffer roll drive sets the buffer rolls again into motion when the intermediate roll sensor reports that the section of film has left the region being monitored. As soon as the intermediate roll sensor reports that the section of film has left the section being monitored between the guiding device and the intermediate rolls, it is assured that the section of film has been wound completely into the second buffer. The section of film can now be transported to the exit where it can be taken over by the next processing station.

In another preferred embodiment, the buffer rolls exhibit a pair of reversing rolls which wind the section of film into the second buffer and wind it out of the second buffer in the opposite direction of motion, a reversing guiding device being provided which guides the section of film in the direction toward the exit rolls as it is being wound out. In some cases, it may be desirable to have the film enter the next processing station, for example, the development station, with the same orientation. In this case it is advantageous to reverse the section of film again, for which purpose the pair of reversing rolls and the reversing guiding device are provided. The pair of reversing rolls advantageously moves the section of film essentially vertically. The second buffer is then arranged essentially underneath the pair of reversing rolls. The danger of scratching the film during the winding in and winding out process in the buffer is relatively minor.

The reversing guiding device preferably exhibits a diverting edge which is arranged on the side of a plane intersecting the roll nip of the pair of reversing rolls away from the pair of exit rolls and next to the pair of reversing rolls. Thus, the reversing guiding device is constructed with reference to the pair of reversing rolls in a manner similar to the guiding device with reference to the intermediate rolls. The section of film which is being wound into the second buffer tail first, is now again wound out of the second buffer head first, the head of the section of film being deflected by the diverting edge in the direction of the exit rolls. In so doing, it is preferred that a reversing sensor be provided which detects whether the section of film has been wound into the second buffer far enough so that its head will be deflected by the reversing guiding device in the direction of the exit rolls as it is being wound out. Here too, it is important that the section of film has been wound far enough into the second buffer so that its head has been moved past the diverting edge. As the section of film is being wound out of the second buffer it now reaches the proper side of the reversing guiding device due to its inherent stiffness, which essentially holds it in the plane which intersects the roll nip of the pair of reversing rolls.

It is preferred that a roll separation device be provided which separates the rolls of the intermediate rolls beginning at a time at which the buffer sensor detects the presence of a section of film up to the time at which the intermediate roll sensor reports that the section of film has left the intermediate rolls. When the buffer sensor has detected the section of film, the drive through the intermediate rolls can be shut down. This is especially desirable when the drive of the intermediate rolls and the drive of the buffer rolls run synchronously. Once the rolls of the intermediate rolls have been separated, the section of film can be pulled out of the first buffer without being gripped by the intermediate rolls.

Preferably, the buffer guiding device is interchangeable with the reversing guiding device. It then becomes possible by means of a minor re-arrangement that both intermediate film storage with reversal of a section of film and intermediate film storage without this reversal can be performed with a single intermediate film storage device. The intermediate film storage device is thus highly flexible and can be used for a multiplicity of applications. In so doing, it is preferred that the pair of exit rolls and the pair of buffer rolls exhibit a common drive installation for synchronous drive, the pair of exit rolls and the pair of buffer rolls being connectable by means of a power transmission device at one axial end to rotate in the same direction and at the other axial end to rotate in the opposite direction. By means of a slight re-arrangement by which the power transmission device is re-arranged from one axial end to the other axial end, the direction of rotation of the pair of buffer rolls and of the pair of exit rolls can be altered. This is because in an intermediate film storage device in which the section of film has to be reversed once, the pair of exit rolls and the pair of buffer rolls must have the same direction of transport, while in an intermediate film storage device in which the section of film appears at the exit without reversal, the pair of exit rolls and the pair of buffer rolls must exhibit opposite directions of transport. In a preferred embodiment, the power transmission device also drives the pair of reversing rolls when the pair of exit rolls and the pair of buffer rolls move in opposite directions. For example, the power transmission device can be formed by a chain, a toothed belt, a V-belt or a combination of gears. By means of this advantageous embodiment, the pair of reversing rolls and the pair of exit rolls or the pair of buffer rolls, respectively, can run synchronously without requiring an additional drive installation for the pair of reversing rolls.

What is claimed is:

1. In an intermediate film storage device for a section of photographic film (45, 46) of limited length with a front end and a tail end including feed rolls, exit rolls, intermediate rolls (9, 10), and a guiding device (8) which guides the section of film (45, 46) from the feed rolls to the intermediate rolls (9, 10), the improvement comprising means for having the intermediate rolls (9, 10) transport the section of film (45, 46) front end first into a first buffer (13) at a first transport speed and then further transport the section of film (45, 46) tail end first from said first buffer (13) into a second buffer (26) at a second transport speed greater than said first transport speed, the transport of the section of film (45, 46) in the second buffer (26) being controlled by an arrangement of buffer rolls (14, 15).

2. Intermediate film storage device according to claim 1, characterized by the guiding device (8) extending from the intermediate rolls (9, 10) toward the buffer rolls (14, 15) so as to guide the section of film (45, 46) into the second buffer (26) during said further transport.

3. Intermediate film storage device according to claim 2, characterized by the guiding device (8) having a diverting edge (11) which is arranged on the side of a plane intersecting a roll nip (12) of said intermediate rolls (9, 10), away from the second buffer (26), and adjacent to the intermediate rolls (9, 10).

4. Intermediate film storage device according to claim 3, characterized by means for having the intermediate rolls (9, 10) move the section of film (45, 46) essentially vertically.

5. Intermediate film storage device according to claim 4, characterized by the guiding device (18) in the section between the intermediate rolls (9, 10) and the buffer rolls (14, 15) having a sliding surface and a deflection device (17) for moving a part of the section of film (45) away from the sliding surface after it has been gripped by the buffer rolls (14, 15).

6. Intermediate film storage device according to claim 5, characterized by the deflection device (17) comprising an eccentric roll.

7. Intermediate film storage device according to claim 2, characterized by having positioned, between the guiding device (8) and the intermediate rolls (9, 10), an intermediate roll sensor (34) which detects the presence of the section of film (45, 46) in this region and controls a drive (27) of the intermediate rolls (9, 10).

8. Intermediate film storage device according to claim 1, characterized by the buffer rolls (14, 15) having a buffer roll sensor (35) which detects the presence of the section of film (45, 46) in a predetermined region, the output signal of said sensor (35) controlling a buffer roll drive (32).

9. Intermediate film storage device according to claim 1, characterized by the buffer roll sensor (35) having means for shutting down the buffer roll drive (32) when it detects the section of film (45, 46).

10. Intermediate film storage device according to claim 9, characterized by the buffer rolls comprising a pair of buffer rolls (14, 15) and a pair of exit rolls (20, 21) which is connected by a buffer guiding device (22).

11. Intermediate film storage device according to claim 9, characterized by the buffer sensor (35) being arranged at the exit of the buffer rolls.

12. Intermediate film storage device according to claim 9, characterized by the buffer roll drive (32) having means for setting the buffer rolls (14, 15) into motion when the intermediate roll sensor (34) reports that the section of film (45, 46) has left the region being monitored.

13. Intermediate film storage device according to claim 1, characterized by the buffer rolls having a pair of reversing rolls (23, 24) which transport the section of film into the second buffer and transport said film section out of the second buffer (26) by moving said section in the opposite direction, a reversing guiding device (42) being provided which directs the section f film (45) in the direction of the exit rolls (20, 21) as said film section is being transported out.

14. Intermediate film storage device according to claim 13, characterized by the pair of reversing rolls (23, 24) having means for moving the section of film (45) essentially vertically.

15. Intermediate film storage device according to claim 13, characterized by the reversing guiding device (42) having a diverting edge (44) which is arranged on the side of a plane intersecting a roll nip (43) of the pair of reversing rolls (23, 24), away from the pair of exit rolls (20, 21), and adjacent to the pair of reversing rolls (23, 24).

16. Intermediate film storage device according to claim 13, characterized by having a reversing sensor (36) which detects whether the section of film (45) has been transported into the second buffer (26) far enough so that its head is diverted by the reversing guiding device (42) in the direction of the exit rolls (20, 21) as said film section is being transported out.

17. Intermediate film storage device according to claim 13, characterized by including a roll separation device (29, 30) which separates the rolls of the intermediate rolls (9, 10) beginning at a point in time at which the buffer sensor (35) detects the presence of the section of film (45) until a point in time at which the intermediate roll sensor (34) reports that the section of film (45) has left the intermediate rolls (9, 10).

18. Intermediate film storage device according to claim 13, characterized by the pair of exit rolls (20, 21) and the pair of buffer rolls (14, 15) having a common drive installation (32) for synchronous drive, where the pair of exit rolls (20, 21) and the pair of buffer rolls (14, 15) are connected by means of a power transmission device (33, 41) at one axial end for rotation in the same direction, and at the other axial end for rotation in the opposite direction.

19. Intermediate film storage device according to claim 18, characterized by the power transmission device (41) having means for driving the pair for reversing rolls (23, 24) when the pair of exit rolls (20, 21) and the pair of buffer rolls (14, 15) move in opposite directions.

* * * * *